United States Patent [19]

Duda

[11] 3,950,847

[45] Apr. 20, 1976

[54] DRY SHAVER

[75] Inventor: Herbert Duda, Wels, Austria

[73] Assignee: U.S. Philips Corporation, New York, N.Y.

[22] Filed: July 9, 1974

[21] Appl. No.: 486,771

[30] Foreign Application Priority Data

July 10, 1973 Austria ..... 6051/73

[52] U.S. Cl. ..... 30/34.1

[51] Int. Cl.[2] ..... B26B 19/10

[58] Field of Search..... 30/34.1, 223, 224

[56] References Cited

UNITED STATES PATENTS

| | | | |
|---|---|---|---|
| 2,870,534 | 1/1959 | Angst | 30/34.1 |
| 3,421,214 | 1/1969 | Rinck | 30/34.1 |
| 3,456,341 | 7/1969 | Loner | 30/34.1 |

*Primary Examiner*—Al Lawrence Smith
*Assistant Examiner*—Gary L. Smith
*Attorney, Agent, or Firm*—Frank R. Trifari; J. David Dainow

[57] ABSTRACT

A dry-shaver having a reciprocating drive cutter that cooperates with a stationary counter-cutter, the latter being resiliently mounted on a stationary part of the dry-shaver housing and urged against the driven cutter.

7 Claims, 5 Drawing Figures

DRY SHAVER

BACKGROUND OF THE INVENTION

The invention relates to a dry-shaver having reciprocating cutters which are associated with at least one shaving section and at least one trimmer, and the cutting surfaces of which are pressed into resilient engagement with cutting surfaces of associated counter-cutters. The receiprocating cutter of the shaving section is located at that side of the associated counter-cutter which faces away from the skin while the cutter of the trimmer is located at that side of the associated counter-cutter which faces toward the skin during use of the dry-shaver. The cutters together form an integral unit while the counter-cutter of the trimmer is mounted on a stationary part of the dry-shaver, preferably on the frame of a shaving head.

In such a dry-shaver, which is described in U.S. Pat. No. 2,870,534, the drivable cutters for the shaving section and for two trimmers are constitued by a single elastic foil member which is interposed between the counter-cutters of the trimmers and of the shaving section. The counter-cutters of the trimmers are mounted on the frame of a shaving head, while the counter-cutter of the shaving section is arranged on a support which is mounted on the frame of the shaving head so as to be readily detachable. When mounting the support on the shaving-head frame the elastic foil member which constitutes the drivable cutters is initially tensioned so that the cutters are pressed against the associated counter-cutters. Manufacturing such a foil member is difficult because it has to satisfy conflicting requirements; on the one hand the cutters constituted by the foil member should be as rigid as possible to provide an adequate cutting action, and on the other hand the foil member should be highly resilient so as to ensure that it accurately engages the counter-cutters under initial tension.

SUMMARY OF THE INVENTION

The invention avoids these problems in a simple manner in that the frame-shaped counter-cutter of the trimmer is so mounted on the stationary part of the dry-shaver as to be adjustable substantially in a direction at right angles to the cutting faces by means of a spring assembly. The force of the spring assembly presses the cutting face of the counter-cutter of the trimmer to the cutting face of the drivable cutter associated with the trimmer while simultaneously the cutting face of the drivable cutter of the shaving section is pressed by said assembly to the cutting face of the counter-cutter associated with the shaving section. Hence the basic principle of the invention is to press the drivable cutters to the associated stationary counter-cutters by means of the stationary counter-cutter of the trimmer which is resiliently mounted on the dry-shaver. This results in a simple construction while the cutters and the spring assembly can each be given optimum proportions and a single spring assembly which is stationary during operation of the dry-shaver is sufficient to press the drivable cutters to the associated counter-cutters, ensuring smooth motion and consequent full engagement of the drivable cutters with the counter-cutters.

A very simple construction of the dry-shaver is provided if the spring assembly comprises at least two coil springs enclosed between the stationary part of the dry-shaver and the counter-cutter of the trimmer.

It has furthermore proved advantageous for the spring assembly to take the form of at least one elongated leaf spring, the two free ends of which each bear the dry-shaver which extend at right angles to the direction of the reciprocating driving movement, while the part intermediate the free ends bears at at least one location on the counter-cutter of the trimmer. With a view to simple construction it has proved of advantage for the leaf spring to be bent into the form of at least one shallow V, the or each bend bearing on the counter-cutter in the region of the plane of symmetry of the counter-cutter which extends at right angles to the direction of the reciprocating driving movement. Advantageously the leaf spring along its length comprises an odd number of bends and bears on the counter-cutter of the trimmer at the locations of the odd bends, resulting in particularly good engagement of the cutting faces of the cutters. A particularly simple construction is obtained if a single broad leaf spring is used which formed with an opening for the passage of a driving member which cooperates with the drivable cutters.

In order to avoid relative movement between the leaf spring and the stationary counter-cutter of the trimmer in the direction of the reciprocating movement of the drivable cutters during operation, the leaf spring may be provided with at least one projection which fits in an opening formed in the counter-cutter of the trimmer.

Furthermore it has been found to be of advantage when a free end of the leaf spring for the purpose of support is hinged to one of the two lateral portions of the stationary part of the dry-shaver, while the other free end of the leaf spring is detachable from its support in the other lateral portion of the stationary part of the dry-shaver, so that when mounting the cutter assembly the leaf spring is movably but securely attached to the dry-shaver. In this connection it has proved of particular advantage for the drivable cutters of the shaving section and of the trimmer, which cutters form an integral unit, and the counter-cutter of the trimmer to be detachably but securely attached to the leaf spring so as to form an integral assembly which can be pivoted out of its operational position on the stationary part of the dry-shaver, permitting for example cleaning to be performed in a simple manner without the likelihood of individual components being lost.

Embodiments of the invention will now be described, by way of example, with reference to the accompanying diagrammatic drawings:

DETAILED DESCRIPTION OF THE PREFERRED EMBODIMENT

Figure 1:
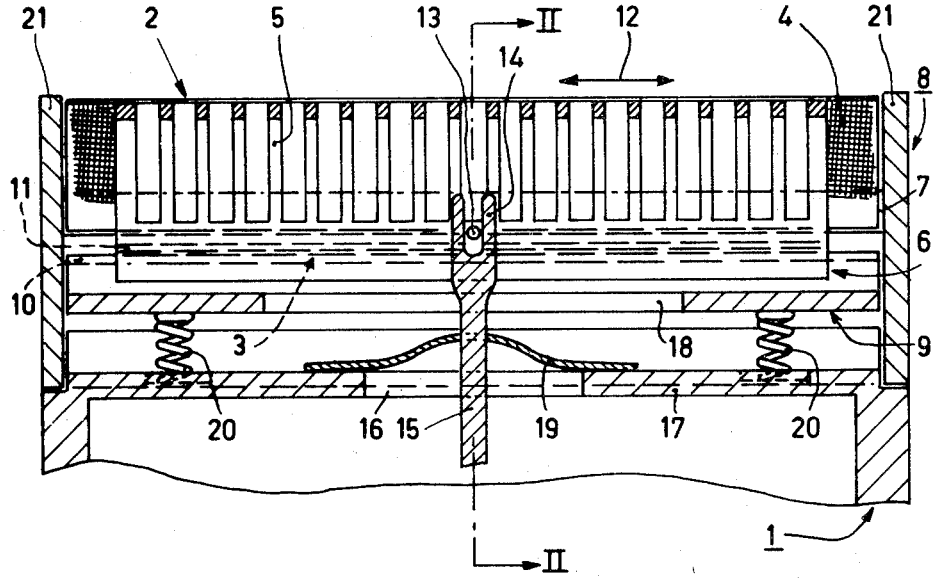
FIG. 1 is a side elevation view in section of a dry-shaver in which the spring assembly comprises four coil springs.
Figure 2:
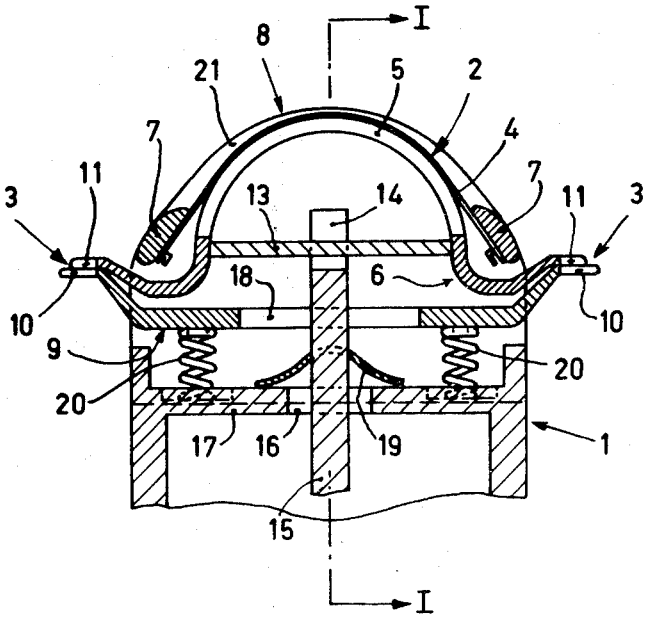
FIG. 2 is a cross-sectional view thereof taken along line II—II of FIG. 1.

Referring now to FIGS. 1 and 2, a dry-shaver has a casing 1, a shaving section 2 and a trimmer 3. The shaving section 2 has an upper cutter or counter-cutter in the form of a shear foil 4, one face of which faces toward the skin during use of the dry-shaver. Instead of a shear foil which is flexible as a whole, a rigid cutter may obviously be provided. The shear-foil face which faces the way from the skin and forms its cutting face is engaged by blades 5 of a reciprocating cutter 6 which have arcuate cutting faces. The shear foil has openings along its side edges by which it is secured to cross-pieces 7 of a support 8 which can be mounted on the casing 1 of the dry-shaver and is detachably retained in this position by means not shown.

The two trimmers 3 have a counter-cutter 9 which faces away from the skin during use of the dry-shaver. The counter-cutter has the form of a frame which carries a cutting comb 10 along each longer edge of the frame. The cutting faces of the two combs 10 cooperate with cutting faces of combs 11 which extend from the reciprocating cutter 6 and face toward the skin during use of the dry-shaver.

Thus, the blades 5 and the combs 11 form an integral unit. Obviously, this is not necessary and the blades 5 and combs 11 may alternatively be mounted on separate component parts which in turn may be combined in a suitable manner to form an assembly adapted to be driven as a unit. To enable the cutter unit 6 to be reciprocatingly driven in the directions indicated by a double-headed arrow 12, the unit has a cross-piece 13 which extends at a right angle to the driving direction and enganges in a fork 14 of a rocking lever 15 of a vibrator-type motor, not shown, which is accommodated in the casing 1 of the dry-shaver. The rocking lever projects through an opening 16 in a wall 17 of the casing and through an opening 18 in the counter-cutter 9 of the trimmer. A seal 19 mounted on the rocking lever covers the opening 16 and hence prevents cuttings from penetrating into the casing.

For pressing the cutting faces of the blades 5 and of the combs 11 of the drivable cutter 6 into resilient engagement with the associated stationary counter-cutters of the shaving section and the two trimmers, i.e. the shear foil 4 and the counter-cutter 9 respectively, a spring assembly comprising four coil springs 20 is provided which cooperates only with stationary component parts of the dry-shaver. For this purpose the stationary counter-cutter 9 of the two trimmers is mounted on the casing 1 so as to be movable substantially in a direction at a right angle to the cutting faces and thus transmits the force of the spring assembly to the drivable cutter 6 which in turn bears on the stationary counter-cutter of the shaving section, i.e. on the shear foil 4. The coil springs 20 are connected at one end to the casing wall 17 through which the rocking lever 15 passes and at the other end to the counter-cutter so that the latter is urged away from the wall 17 toward the shear foil 4. Thus the force of the spring assembly presses the cutting faces of the counter-cutter 9, which are constituted by the combs 10, against the cutting faces of the associated drivable cutter 6 of the trimmer, which are constituted by the combs 11, and simultaneously the cutting faces of the drivable cutter 6 of the shaving section, which are constituted by the blades 5, against the cutting face of the shear foil 4.

As FIG. 1 shows, the stationary counter-cutter 9 has a length such as to extend between lateral parts 21 of the support 8 with a small amount of clearance only. Thus the counter-cutter 9 is simply prevented from following the movement of the driven cutter 6, which naturally would be undesirable. Obviously this may be effected in another manner; for example, the counter-cutter 9 may be locked against movement in the driving direction 12 by a pin-and-hole connection between the wall 17 and the counter-cutter 9.

Because the spring assembly acts on stationary component parts only, it is not subject to motion when the cutter 6 is driven. This ensures that during the entire reciprocating driving movement of the cutter 6 the contacting cutting surfaces engage one another reliably and completely, which is of particular importance to provide satisfactory cutting operation. The simple construction described further permits simple assembling of the dry-shaver, which comprises the steps of mounting the counter-cutter 9 and the coil springs 20 on the casing, placing the driving cutter 6 on the counter-cutter 9 so that the cross-piece 13 is inserted into the fork 14 of the rocking lever 15, and finally placing the support 8 with the shear foil 4 on the casing, which causes the coil springs 20 to be tensioned so that they cause the cutting surface to be pressed together. The construction also permits effective and simple cleaning, because the support 8 only is to be taken off, after which the cuttings can simply be removed from the separately accessible parts, in particular the cutting surfaces of the cutters.

In the embodiment described a further advantage is obtained in that the arcuate blades 5 can turn in the arched shear foil 4. For if in operation one of the two trimmers engages the skin and as a result is subjected to a pressure in a direction substantially at right angles to the cutting surfaces, the two cutters 6 and 9 can yield to this pressure within given limits against the action of the springs 20, thus preventing the trimmer from being pressed against the skin with excessive pressure.

Obviously it is not absolutely necessary for the axes of the four coil springs 20 to be parallel; as an alternative, all the four axes may be inclined towards the rocking lever 15. Also, the spring assembly may comprise a single coil spring arranged coaxially with the rocking lever.

Figure 3:
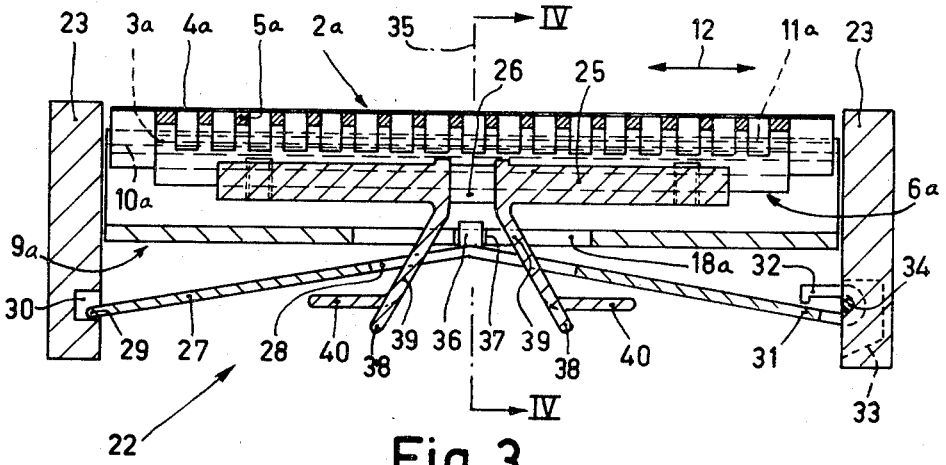
FIG. 3 is a side elevation view in section of another embodiment of a dry-shaver in which the spring assembly comprises a single broad leaf spring bent into the form of a shallow V.
Figure 4:
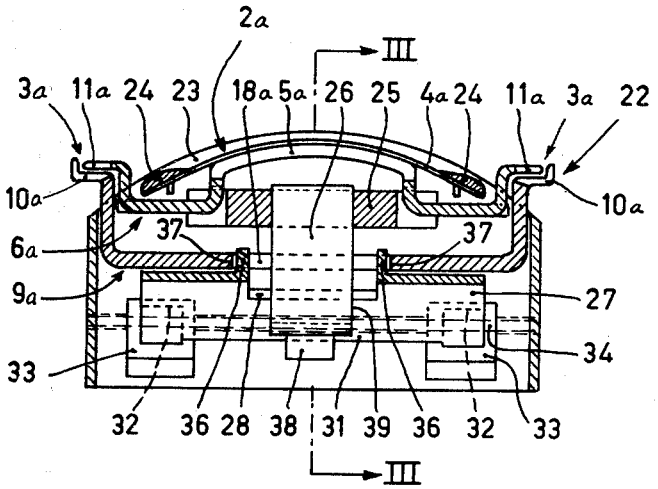
FIG. 4 is a cross-sectional view thereof taken on the line IV—IV of FIG. 3.

FIGS. 3 and 4 show a shaving head 22 adapted to be mounted on a casing, not shown, of a dry-shaver. The shaving head has a frame which comprises two side-parts 23 interconnected by cross-pieces 24. A shear foil **4*a*, which constitutes the stationary counter-cutter of a shaving section 2*a*, is attached to the cross-pieces 24 in a conventional manner. The shaving head further comprises two trimmers 3*a* which have a common stationary counter-cutter 9*a* provided with two combs 10*a*. The drivable cutters associated with the counter-cutters 4*a* and 9*a* take the form of an integral cutter unit 6*a* which comprises blades 5*a*, which cooperate with the shear foil 4*a*, and along its longer edges combs 11*a*, which cooperate with the combs 10*a*. The cutter unit 6*a* is joined to a plate-shaped member 25 formed with an aperture 26 for cooperation with a rocking lever, enabling the cutter unit 6*a*** to be reciprocatingly driven when the shaving head is mounted on the casing of the dry-shaver.

In this embodiment the spring assembly comprises a single elongate leaf spring 27. The leaf spring is broad and consequently supports the counter-cutter **9*a* over a wide area. At its middle it is formed with an opening 28 through which the rocking lever passes. The two free ends of the leaf spring bear on the side-parts 23 of the shaving-head frame, one end 29 extending into a recess 30 in one side-part 23, while the other end 31 has two lugs 32 which extend into two recesses 33 in the other side-part 23; a pin 34 is inserted into this side-part so as to pass through the recesses 33 and the lugs 32. Thus the end 31 of the leaf spring is hinged to one of the two side-parts 23 while the other end 29 can be removed from the recess 30 in the other side-part 23, as will be described more fully hereinafter. The leaf spring 27 is bent along a line at right angles to its length so as to form a shallow V, the base of the V bearing on the counter-cutter 9***a* in the area of a plane of summetry 35 which extends at right angles to the direction of the reciprocating driving movement. The leaf spring 27 has two projections 36 which fit in corresponding openings in the counter-cutter 9*a*, preventing relative movement between the leaf spring and the counter-cutter 9*a* in the direction of the reciprocating driving movement.

The part 25 joined to the drivable cutter 6*a* has two resilient bent lugs 39 which each are provided with a grip 38 and are arranged, viewed in the direction of the reciprocating driving movement, one or either side of the opening 26. The two lugs project through the opening 18*a* in the counter-cutter 9*a* and through the opening 28 in the leaf-spring 27, the bent free ends 40 of the lugs enganging under the leaf spring. Thus the drivable cutter unit 6*a* and the counter-cutter 9*a* of the trimmer together with the leaf spring 27 constitute a unit which cannot be lost but owing to the hinged attachement of the leaf spring to the shaving-head frame can be pivoted away therefrom.

The shaving-head is assembled wherein first the end 31 of the leaf spring engages the associated side-part 23 of the shaving-head frame so as to be pivoted away therefrom. Then the combs 11*a* of the cutter 6*a* are brought into engagement with the combs 10*a* of the counter-cutter 9*a*, the lugs 39 passing through the opening in the counter-cutter 9*a*. Subsequently a bent end 40 of one lug 39 is inserted into the opening 28 in the leaf spring 27, after which the grips 38 of the two lugs are pressed together so that the second lug can be passed through the opening in the leaf spring. Releasing the grips causes the lugs to spring back, securing the cutters 6*a* and 9*a* to the leaf spring. Then the lugs 32 of the leaf spring are inserted into the recesses 33 in the relevant side-part 23 and pivoted towards the shaving-head frame, the counter-cutter 9*a* together with the cutter 6*a* being introduced between the side-parts 23. When the blades 5*a* reach the shear foil 4*a*, the leaf spring 27 is tensioned and its lugs 32 are removed from the recesses 33 to an extent such that the end 29 enters the recess 30 in the other side-part 23 and the projections 36 engage in the associated openings 37 in the counter-cutter 9*a*. In this position the tensioned leaf spring 27 with the base of the V urges the combs 10*a* of the counter-cutter 9*a* into contact with the combs 11*a* of the drivable cutter 6*a* which in turn with its blades 5*a* engages the shear foil 4*a*; the free end 29 of the leaf spring is supported in the recess 30, and the free end 31 is supported through the lugs 32 by the pin 34.

Disassembly of the shaving head is effected in reverse order, the leaf spring 27 being gripped and tensioned further until the projections 36 are removed from the openings 37 in the counter-cutter 9*a*, after which the lugs 32 are inserted into the recesses 33 until the free end 29 leaves the recess 30. The spring then expands and can be pivoted away from the shaving-head frame, the counter-cutter 9*a* and the cutter 6*a* being simultaneously removed from the shaving-head frame. Owing to the lugs 39, in this position of the leaf spring the two cutters 6*a* and 9*a* are securely attached thereto. The cutters 6*a* and 9*a* then are freely accessible, so that they can simply be cleaned. If the cutters 6*a* and 9*a* are to be detached from the leaf spring, the lugs 39 are urged together and removed first from the opening 28 in the leaf spring and then from the opening 18 in the counter-cutter 9*a*. If desired, the leaf spring 27 may further be provided with grips with facilitate tensioning and expanding.

Figure 5:
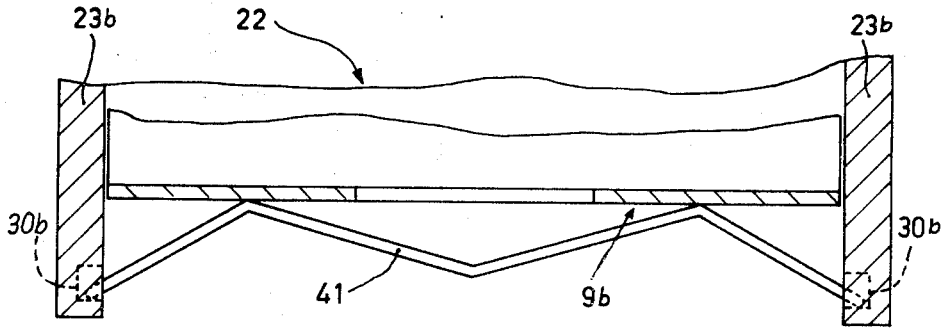
FIG. 5 is a schematic sectional view of an embodiment using leaf springs bent into at least two shallow V's.

In the shaving head shown in FIG. 5, the spring assembly comprises two elongate leaf springs 41 which are arranged laterally of the plane of symmetry of the shaving head, which plane extends in the direction of the reciprocating driving movement, permitting a driving means for the drivable cutter unit, not shown, to pass between them. Each leaf spring 41 is bent three times along its length and bears on the counter-cutter 9*a* of the trimmer with the first and third bends. The free ends of the leaf springs are inserted and supported in recesses 30*b* formed in the side-parts 23*b* of the shaving-head frame. Thus a spring device is obtained which similarly to the embodiment of FIGS. 2 and 1 engages the counter-cutter 9*a* of the trimmers at four points and consequently presses the counter-cutter 9*a* securely to the drivable cutter unit and urges the latter securely into engagement with the counter-cutter of the shaving section.

Obviously the above-described embodiments may be modified in a variety of ways without departing from the scope of the invention, in particular in respect of the construction of the spring device and the manner in which it bears on the counter-cutter of the trimmer and on the stationary part of the dry-shaver. In this connection it should be mentioned that as an obvious alternative only a single trimmer may be provided, the combs of the second trimmer being replaced by a sliding engagement of the two cutters.

I claim:

1. In a dry shaver including a casing with a drive means extending outward therefrom, a shaver housing attachable to said casing adjacent said drive means, said housing including a shear plate mounted thereon with an inward facing cutting surface, the improvement in combination therewith comprising a reciprocally movable cutter member having a shaver part engaging said cutting surface of the shear plate and a trimmer part extending transversely therefrom, a counter-cutter having a trimmer comb part inward of and engaging said trimmer part of the cutter, and spring means engaging and resiliently urging said counter-cutter and the trimmer comb part thereof outward from said casing, with said trimmer comb part of the counter-cutter thus urged outward resiliently against said trimmer part of the cutter member, said cutter member and the shaver part thereof thus being urged resiliently outward, with said shaver part urged resiliently against said shear plate.

2. Dry shaver as claimed in claim 1, wherein said spring means comprises at least one elongate leaf spring, the two free ends of which each bear on the casing while the spring part between the free ends bears on the counter-cutter.

3. Dry-shaver as claimed in claim 2, characterized in that the leaf spring is bent into the form of a shallow V, the base of the V bearing on the counter-cutter at the area of the plane of symmetry thereof which extends at right angles to the direction of the reciprocating driving movement.

4. Dry-shaver as claimed in claim 2, characterized in that the leaf spring along its length is bent an odd number of times and bears on the counter-cutter at the areas of the odd bends.

5. Dry-shaver according to claim 1, wherein said spring means comprises a leaf spring with an aperture for the passage therethrough of said drive means.

6. Dry-shaver according to claim 5 wherein said leaf spring has at least one projection which engages the counter-cutter.

7. Dry-shaver according to claim 5 wherein said leaf spring has a first end hinged to said casing and a second end detachably secured to said casing.

* * * * *

UNITED STATES PATENT AND TRADEMARK OFFICE

CERTIFICATE OF CORRECTION

PATENT NO. : 3,950,847

DATED : April 20, 1976

INVENTOR(S) : HERBERT DUDA

It is certified that error appears in the above-identified patent and that said Letters Patent are hereby corrected as shown below:

Col. 3, line 14, after "its" should be --longer,--

Col. 6, line 23, "9a" should be --9b-- line 28, "9a" should be --9b-- line 29, "9a" should be --9b--

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*